United States Patent [19]

Martin et al.

[11] Patent Number: 4,546,852

[45] Date of Patent: Oct. 15, 1985

[54] ADJUSTABLE SERVICE PLATFORM APPARATUS FOR A GANTRY CRANE

[75] Inventors: John F. Martin, Ocean Springs; Charles H. Zweifel, Biloxi, both of Miss.

[73] Assignee: Fruehauf Corporation, Gulfport, Miss.

[21] Appl. No.: 577,676

[22] Filed: Feb. 7, 1984

[51] Int. Cl.[4] ..... E04G 3/10

[52] U.S. Cl. ..... 182/12; 182/37; 182/62.5; 182/69; 182/142

[58] Field of Search ..... 182/142, 12, 62.5, 148, 182/36, 37, 145, 63, 69, 13, 14, 141

[56] References Cited

U.S. PATENT DOCUMENTS

| | | | |
|---|---|---|---|
| 748,962 | 1/1904 | Lewis | 182/142 |
| 803,717 | 11/1905 | Schwarz | 182/62.5 |
| 2,067,344 | 1/1937 | Ringe | 182/36 |
| 3,302,976 | 2/1967 | Grant | 182/37 |
| 3,454,133 | 7/1969 | Gregord | 182/142 |
| 3,814,211 | 6/1974 | Pamer | 182/142 |
| 3,817,346 | 6/1974 | Wehmeyer | 182/63 |
| 3,820,631 | 6/1974 | King | 182/63 |

FOREIGN PATENT DOCUMENTS

| | | | |
|---|---|---|---|
| 659708 | 4/1979 | U.S.S.R. | 182/142 |
| 696131 | 11/1979 | U.S.S.R. | 182/63 |

*Primary Examiner*—Reinaldo P. Machado
*Assistant Examiner*—Alvin Chin-Shue
*Attorney, Agent, or Firm*—Bruce & McCoy

[57] ABSTRACT

An adjustable service platform apparatus for a gantry crane has an elongated base frame generally conforming in size and shape to a conventional load carrying lifting spreader, and twin service platform units secured to opposite lateral ends of the base frame. Work platforms atop the service platform units can be raised and lowered and laterally extended and retracted independently from the hoist and trolley motions of the crane, with the crane's hoist and trolley motions being interlocked with the position of the work platforms. Using work platform controls operators standing on the work platforms can readily access and inspect the structural elements of the crane's A-frame supporting structure and the crane's boom structure from the top of the boom to the base of the crane. The work platforms can additionally have inboard and outboard extensions for readily accessing the interior of the boom structure and the outside surfaces of the A-frame structure.

9 Claims, 12 Drawing Figures

ADJUSTABLE SERVICE PLATFORM APPARATUS FOR A GANTRY CRANE

BACKGROUND OF THE INVENTION

The present invention generally relates to the field of gantry type cranes used for handling standardized cargo containers and more particularly it relates to the periodic inspection, painting and servicing of the large structural elements of the crane supporting frame and boom structure as recommended by the manufacturer. For example, the crane's support and boom structures must periodically be X-rayed or ultrasonically tested for evidence of structural fatigue, and must periodically be stripped, primed, and repainted.

Inspection and maintenance of large cranes is a time consuming and costly task heretofore involving the use of "skyclimbers" that repell down the crane's structural parts or the use of expensive mobile equipment, or both. Extendible boom gantry cranes, such as the PORTAINER® cranes manufactured by the Paceco subsidiary of the Fruehauf Corporation, are very large crane structures having booms supported 80 feet from the base of the crane. The time required for maintenance operators to climb, inspect and/or service such a structure is substantial with the normal safety risks attendant such working conditions. Also, the normal inspection and maintenance of the boom requires the boom to be extended in its operating position over a waterway. A boom in this position for any length of time can create a hazardous condition for ship traffic.

The present invention provides a new adjustable service platform apparatus which reduces the costs and safety risks associated with crane inspection and maintenance. The adjustable service apparatus can be stowed in a compact shippable form and, when needed, assembled easily at the dock site for use by the crane inspection and maintenance crew. In accordance with the invention the adjustable service platform can be readily engaged and lifted by conventional crane lifting hardware and can be hoisted and trollied by the crane operator and then further adjusted by the platform operator to bring the apparatus' work platforms into position next to any desired structural element of the crane support frame or boom structure. The adjustable platform apparatus provides for independant horizontal and vertical positioning of the work platform to provide, through crane and platform operator control, direct access to structural surfaces being inspected and serviced. Also, the invention provides a stable structure, the movement of which is interlocked to prevent collision with the crane support structure. Consequently, the service platform apparatus of the invention will be relatively safe to operate.

The invention is particularly adapted to be used with standardized crane lifting hardware used worldwide for securing and lifting the standardized shipping containers. The standardized hardware includes an elongated rectangularly shaped steel beam structure known in the industry as a "lifting spreader" which approximately conforms in shape and dimension to the top surface of a cargo container. The lifting spreader is suspended from the ends of the lifting ropes which in turn are suspended from the moveable trolley on the crane's gantry. The spreader lockingly engages to the top of a cargo container by means of four corner twist locks which can be operated remotely by the crane operator in the crane operator's cab. The spreader itself is attached to the ends of the lifting ropes, either through sheaves directly pinned to the top of the lifting spreader or by means of a headblock which connects to the lifting spreader. A conventional style of headblock is a quick release headblock which twist lock connects to the top of the lifting spreader and which can very easily pick up the spreader through a simple crane movement.

SUMMARY OF THE INVENTION

In accordance with the invention, an adjustable service platform apparatus is comprised of a base frame adapted to be lifted by the lifting ropes of an overhead gantry crane and trollied along the crane's gantry. At least one work platform is supported over the base frame and provided with means for raising and lowering the work platform and a means for traversing the working platform relative to the base frame. Both the raising and lowering and traversing means for the work platform are under the control of an operator standing on the work platform. Control means in the crane cab together with the control means on the work platform provide four independent movements for positioning the work platform: two of these independent movements are the vertical lifting of the base frame by the lifting ropes (movement in the "hoist direction"), and the horizontal movement of the base frame along the crane's gantry by means of the crane's trolley (movement in the "trolley direction"). The hoist direction and trolley direction movements are controlled from the cab of the crane in the same manner that a crane operator manipulates and carries a conventional cargo container load. The additional two independent movements involve the movements of the work platform itself over the base frame. These movements permit the platform to be raised and lowered over the base frame and/or extended laterally of the base frame.

In the preferred embodiment of the invention, there will be two "twin" work platforms, one disposed over each of the laterally extended ends of the base frame which preferably has an elongated rectangular shape corresponding to the general shape of a lifting spreader, and which, like a lifting spreader, is carried by the crane lifting ropes in an orientation transverse to the direction of the crane's trolley movement. Thus, in the preferred embodiment the two laterally disposed work platforms will be available to service both sides of the crane's support and boom structure, with each platform having independent vertical and transverse adjustments.

Also, in its preferred embodiment arrangement the base frame of the service platform apparatus will have mechanical means by which the base frame can lockingly be engaged by conventional attachment devices secured to the end of the crane's lifting ropes. For example, such mechanical means may include four twist lock receptacles arranged centrally of the base frame between the two moveable work platforms. The apparatus could then be picked up by a conventional crane headblock, known as a "quick release" headblock, having four twist locks. Other mechanical attachment means can also be provided on the base frame for use with different headblock styles. It is not intended that the invention be limited to any particular crane attachment. Also, it is noted that the lifting spreader that is normally used in the dockside loading operations will preferably be suspended below the base frame to stabilize the service platform apparatus against a tendency to rock.

It is a further aspect of the invention that the hoisting and trolleying movements of the service apparatus are interlocked to the position of the apparatus' work platform relative to the its base frame. In the preferred arrangement interlock means prevent crane operation, that is, the hoisting or trolleying of the entire service apparatus, in the event the work platform is displaced laterally a predetermined distance from its central position; it also limits crane operation in the event the work platform is raised above its lowest position. For additional safety, a crane lockout switch can be provided on the work platform whereby the crane can be disabled by the maintenance operator on the work platform. With the interlock features, the working platform can be maneuvered safely about the crane structure with little risk of the service platform being inadvertently moved to collide with a structural element of the crane.

Still a further aspect of the invention is a service apparatus construction which can easily be assembled and knocked down to a compact shippable size. The base frame to the apparatus serves as a storage platform for the parts and assemblies making up the working platforms and the separate means for raising and lowering and traversing the working platforms. The relatively large and massive construction of the service apparatus can easily be assembled and disassembled with the aid of the cargo container crane which is to be serviced, and using normal workman's hand tools.

Therefore, it can be seen that the primary object of the present invention is to provide a shippable service platform apparatus which can easily be assembled and disassembled on site for servicing the entire support and boom structure of a gantry style cargo container crane from the top of the boom to the base of the crane. Using the invention, the crane's structure can be inspected, maintained and serviced with relative efficiency and relatively little risk of injury to the platform operator, and virtually all boom and A-frame support structural elements are accessible from the apparatus' work platforms. Additional objects of the invention will become apparent from the following specification and claims.

DETAILED DESCRIPTION OF THE PREFERRED EMBODIMENT

Figure 2:
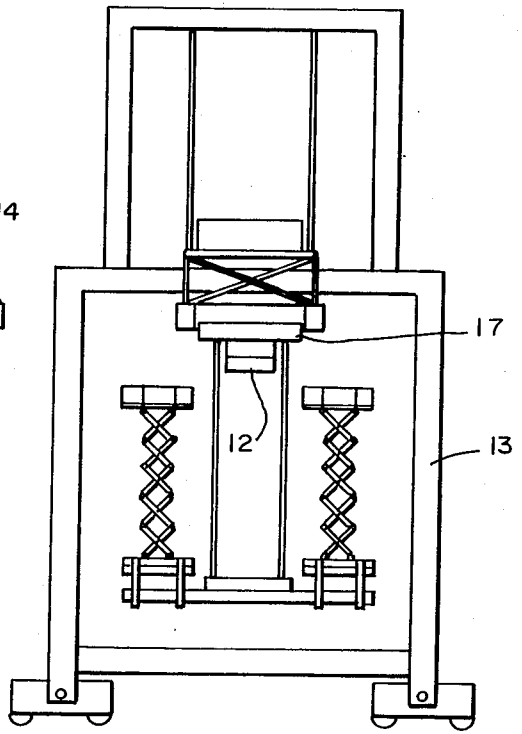
FIG. 2 is a front elevation view of the gantry crane shown in FIG. 1.
Figure 1:
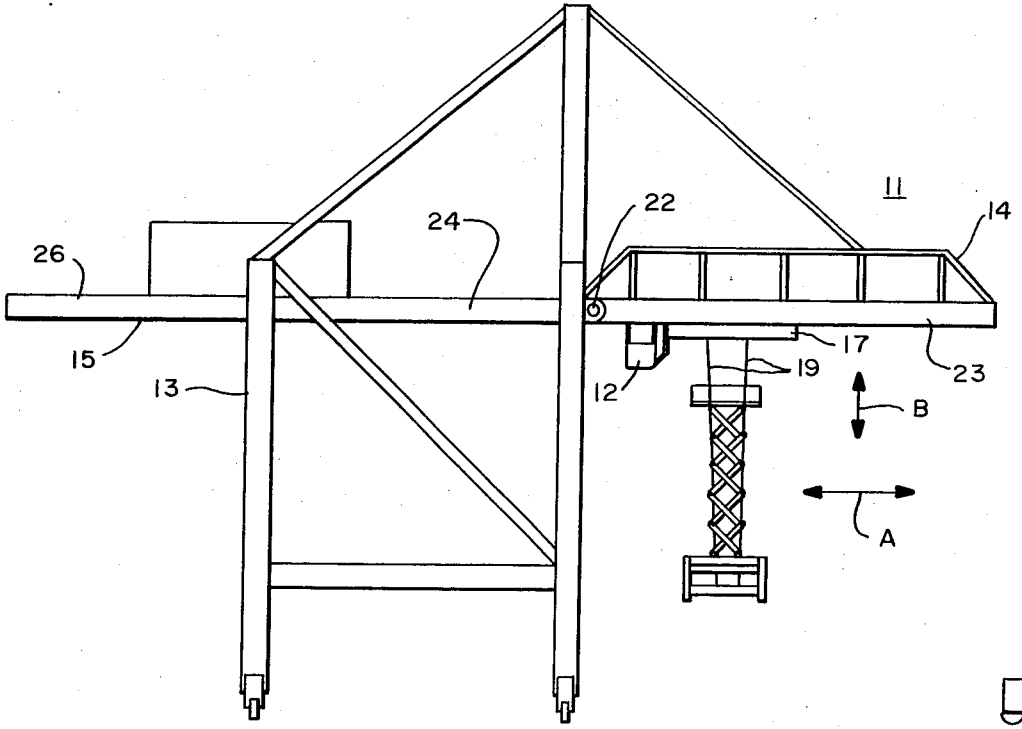
FIG. 1 is a side elevation view of a gantry crane showing an adjustable service platform in accordance with the invention suspended under the crane's gantry by the crane's lifting ropes.

Referring now to the drawings, FIGS. 1 and 2 show a dockside gantry crane, generally denoted by the numeral 11, having a crane supporting A-frame structure 13 which travels along the dock parallel to the waterway on dockside rails (not shown). The boom 14, hinged to the supporting A-frame 13 at boom hinge 22, retractably extends over the waterway, and a load carrying gantry 15 extends through and fore and aft of the A-frame such that the gantry has an outreach portion 23 for loading and unloading over a dockside ship, and a middle rail span and backreach portion 24, 26 for loading and unloading over the dock loading area. A moveable load carrying trolley 17 is supported on gantry rails (not shown) and load lifting ropes 19 depending from the trolley are actuated by means of conventional crane mounted hoist means (not shown) to lift and transport a load along the gantry under the control of a crane operator in the crane cab 12 located below the trolley. It is noted that the horizontal movement of the load along the gantry 15, as denoted by the arrow "A" in FIG. 1, will be referred to herein as movement in the "trolley direction", whereas the vertical movement of the load by the lifting ropes 19, as denoted by the arrow "B", will be referred to as movement in the "hoist direction".

Figure 3:
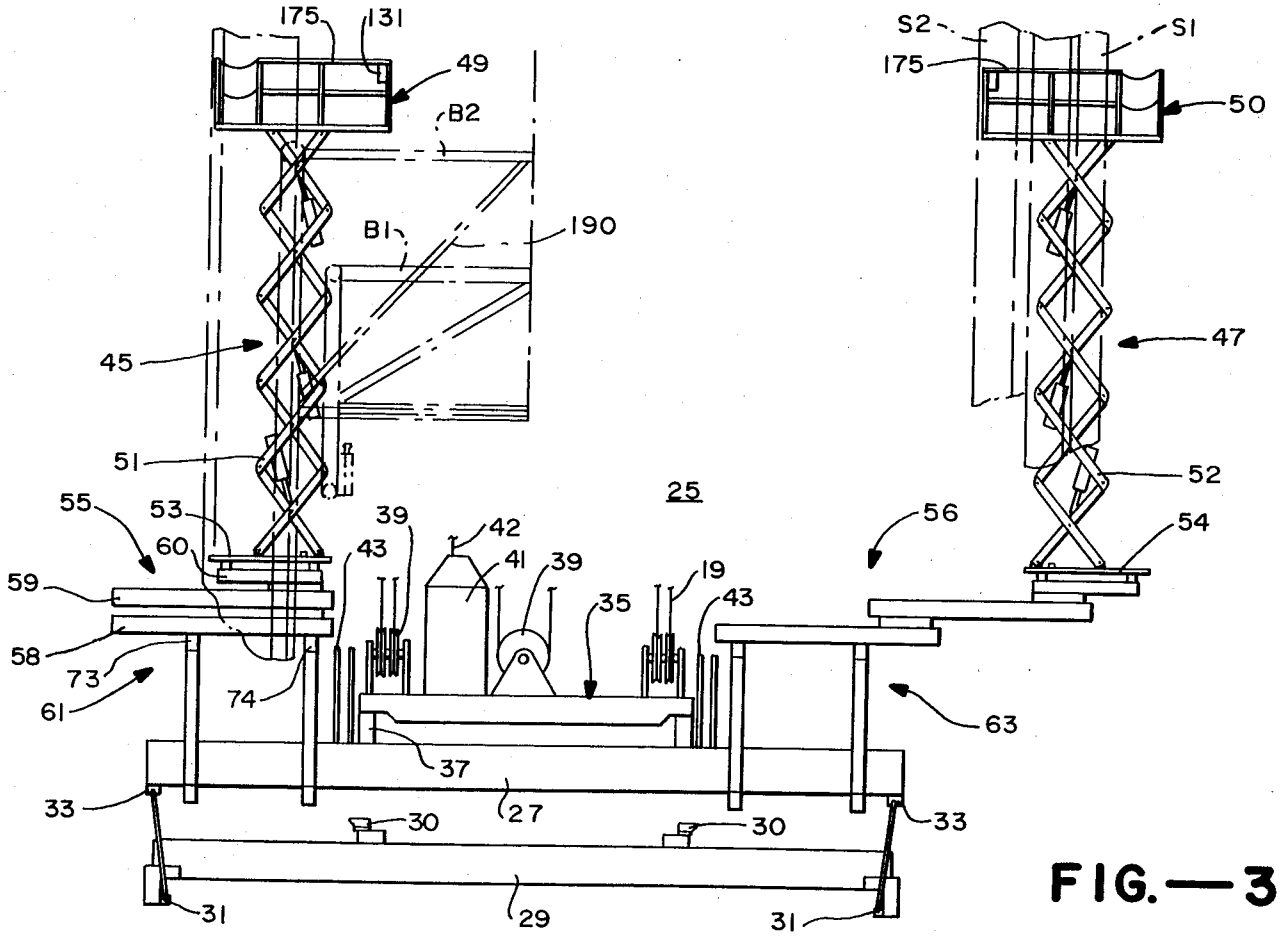
FIG. 3 is a side elevation view of the service platform apparatus of the present invention showing twin working platforms juxtaposed with the boom structures and support structure legs of two different standard sized cranes.

A preferred embodiment of the adjustable service apparatus of the invention, fully assembled for inspecting and maintaining a gantry crane such as shown in FIGS. 1 and 2, is shown in FIG. 3. Referring to FIG. 3, the service platform apparatus 25 has a base frame 27, which is generally rectangular in shape and which generally conforms in size and shape to a cargo container lifting spreader. (As hereinafter described, the normally used lifting spreader 29 is suspended at its four corners 31 underneath and from the four corners 33 of the base frame.) The base frame is carried by the crane's lifting ropes 19 by means of a conventional head block assembly 35. The headblock assembly is seen to have sheave nests 39 through which the lifting ropes 19 are reeved, and a cable tub 41 for holding the electrical cable 42 as it is payed in and out when the headblock is raised and lowered in the hoist direction. The headblock assembly in normal use picks up the lifting spreader 29 between the four corner guides 30 of the spreader; as used with the service apparatus 25, the headblock 35 using twistlocks (not shown) located at its four corners to lockingly engage and pick up the base frame at the frame's headblock supports 37. It is understood that the base frame can be adapted to accommodate any conventional headblock design or can be adapted to any other form of attachment between the lifting ropes and connecting electrical cable and the base frame. For example, twin channel frames 43 are shown disposed outside the headblock supports 37 so that the base frame can also be picked up by a bayonet style quick change headblock used at many dockside facilities.

With further reference to FIG. 3, two identical ("twin") service platform units 45, 47 are mounted to the lateral ends of the rectangular base frame 27 whereby, as shown in FIG. 2, when the entire service platform apparatus is suspended by the cranes lifting ropes 19 in the manner of a cargo container lifting spreader, there will be a work platform 49, 50 disposed laterally of the center of the gantry toward each side of the crane. As will be described below, each of these laterally disposed service platform units will extend for servicing the side of the crane structure toward which it is disposed, and both service platform units can be used at the same time such that both sides of the crane can be inspected and serviced simultaneously by inspection and maintenance personnel working from both platforms.

Each of the service platform units 45, 47 is comprised of a work platform 49, 50 having two opposed outboard hinged extensions 179, 180, an inboard narrow end extension 181, and detachable guardrails 175. The service platform units also have means for raising and lowering the work platforms relative to the base frame, and means for traversing the work platforms laterally of the base frame independent of the vertical raising and lowering motion. In the shown preferred embodiment, the means for raising and lowering the twin work platforms 49, 50 consist of twin hydraulic scissors lifts 51, 52 secured to life bases 53, 54; and the means for traversing the work platforms consist of twin sliding carriage frames 55, 56, each of which has three sections 58, 59, 60 including two slide sections 59, 60.

Referring to FIGS. 1, 2 and 3, it can be seen that when the entire service platform apparatus 25 is suspended by lifting ropes 19 from the crane's trolley 17, each of the twin work platforms 49, 50 atop the twin scissors lifts 51, 52, has four independent degrees of movement that permit the work platforms to access all structural elements of the crane's support structure 13 and boom structure 14. First, the work platforms 49, 50 can be moved together with the base frame in the hoist direction by raising and lowering the lifting ropes 19; secondly, the work platforms can both be moved together with the base frame in the trolley direction by moving the trolley 17 along the girder and boom structures forming the gantry 15; thirdly, each work platform can independently be elevated vertically above the base frame by means of the scissors lifts 51, 52; and fourthly, each platform can independently be extended laterally of the base frame by means of the sliding carriage frames 55, 56.

Figure 4:
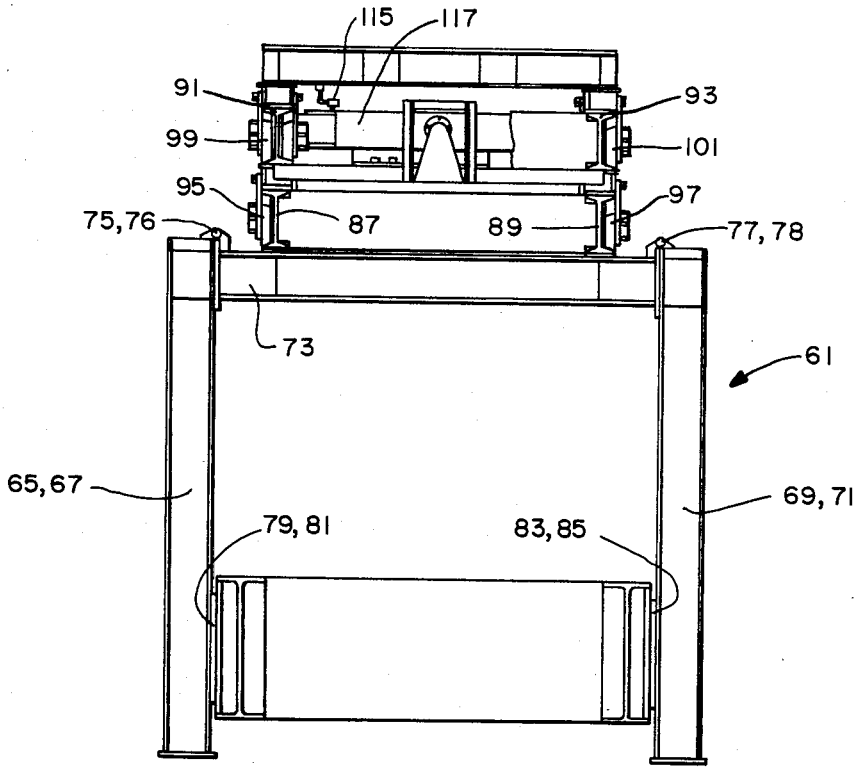
FIG. 4 is an end elevation view of the sliding carriage frame of one service platform unit supported on a tower frame over the base frame of the invention.
Figure 5:
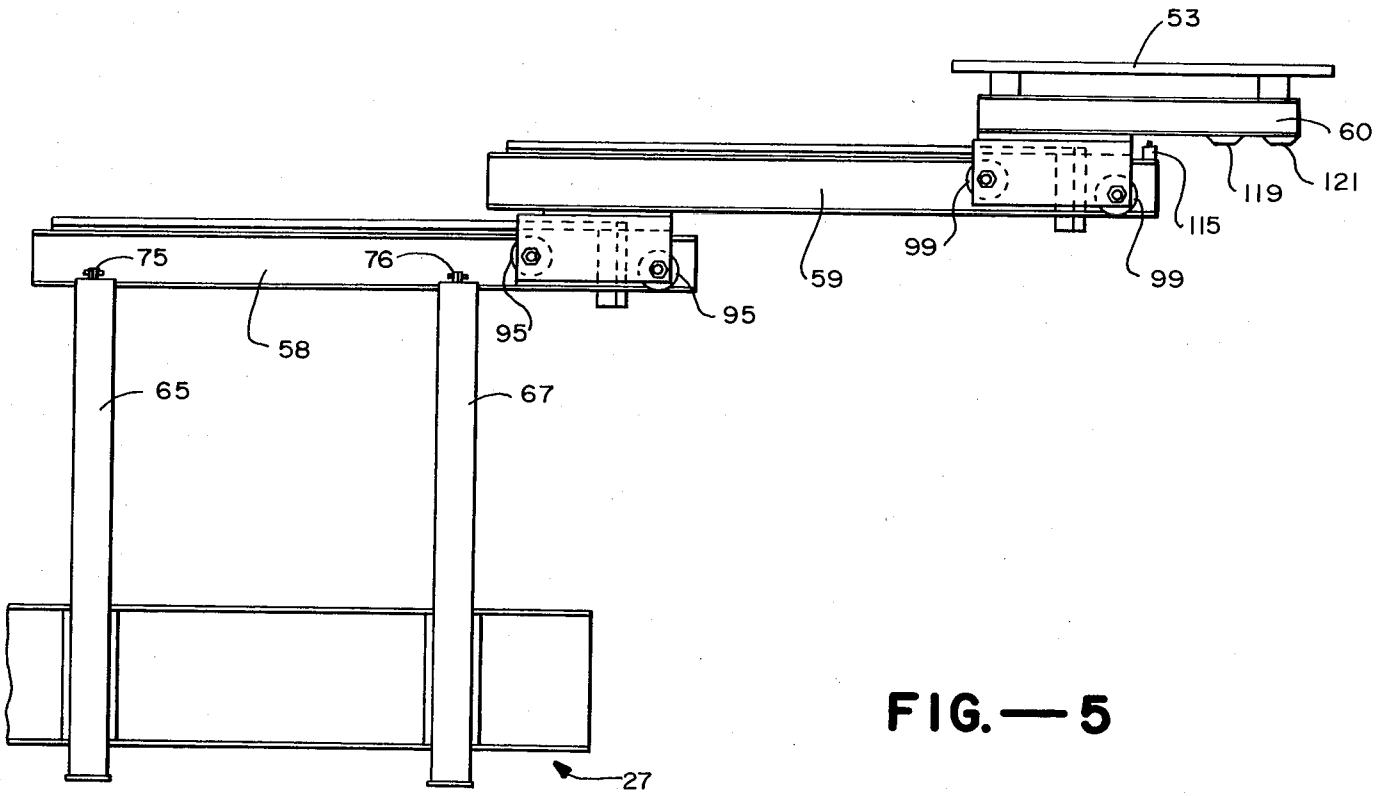
FIG. 5 is a side elevation view of the carriage and tower frame assembly shown in FIG. 4, with the carriage frame extended.

It is next seen that the carriage frames 55, 56 are mounted above the base frame by means of support tower frames 61, 63. As best shown in FIGS. 4 and 5, each tower frame 61, 63 consists of four support posts 65, 67, 69, 71, and horizontal support bars 73, 74 front and rear joining the upper extended ends of adjacent support post pairs 65, 69 and 67, 71. To assemble the tower frames over the base frame the support posts are bolted to the sides of the base frame at four locations 79, 81, 83, 85, whereupon the support bars and support posts are lockingly secured together at their joining ends by means of quick release bolts 75, 76, 77, 78.

Figure 6:
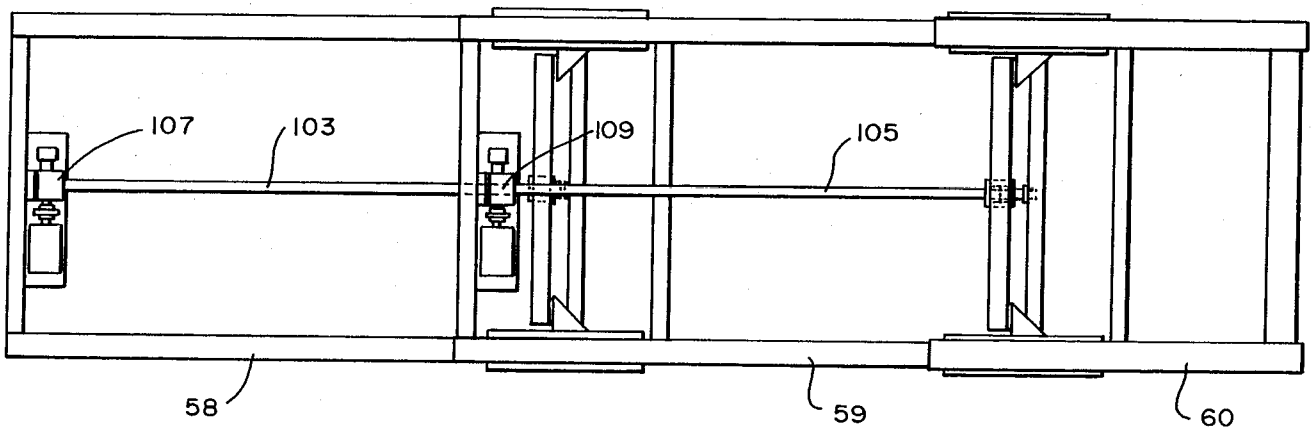
FIG. 6 is a top plan view of the sliding carriage frame shown in FIG. 5 showing the slide section jack screw drives.
Figure 7:
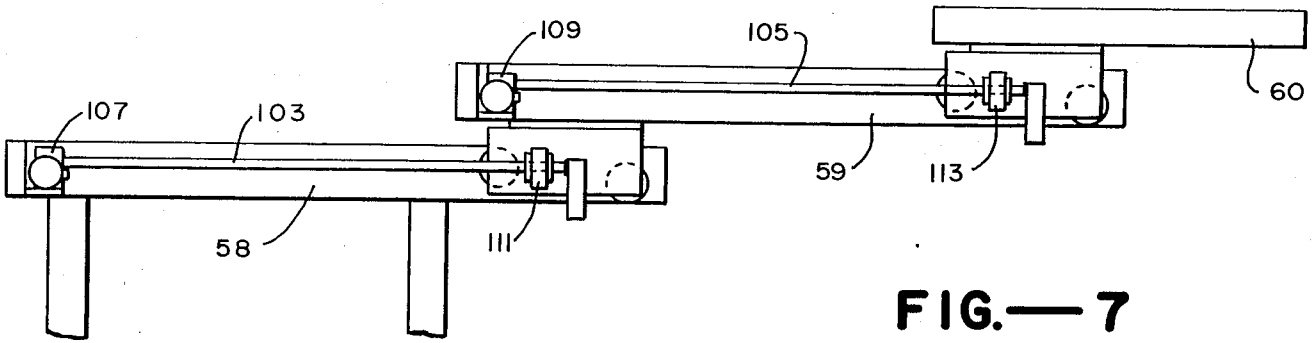
FIG. 7 is a side elevation view of the sliding carriage frame shown in FIG. 6.

The construction of the sliding carriage frames is shown in more detail in FIGS. 4 through 7. The carriage's bottom-most section 58 is mounted to the horizontal support bars 73, 74 of the tower frame 61. The sides of the bottom and intermediate sections 58, 59 are formed by beams 87, 89 and 91, 93, on which the carriage wheels 95, 97 and 99, 101 of the top two moveable slide sections 59, 60 ride. Drive means for the slide sections include separate jack screw drives 103, 105 having separate jack screw motors 107, 109 mounted to the base of each of the sections 58, 59. It can be seen that, when a jack screw motor 107 of the lower slide section 58 is actuated, its associated jack screw 103 will move the intermediate slide section 59 either in or out depending on the direction of rotation of the jack screw in the jack screw collar 111 which is secured to the underside of the intermediate slide section. Similarly, by actuating the jack screw motor 109 the upper slide section 60 is moved relative to the intermediate slide section 59 in accordance with the rotational motion of the jack screw 105 in the jack screw collar 113. By means of the jack screw drives, the sliding carriage frame can be adjusted to any position between the full extension of all slide sections as shown in FIGS. 5, 6 and 7, to a fully retracted position as shown in respect to the left hand service platform unit 45 of the service platform apparatus shown in FIG. 3. In the preferred embodiment the top slide section 60 will extend before the intermediate slide section 59; the reverse is true when the sliding carriage frame retracts. This will ensure proper tripping of the limit switches as described below.

The sliding carriage frame is provided with an interlock means which will provide an interlock between the carriage frame position and the trolley and hoist controls located in the crane's operator cab 12. These interlocks, the operation of which will be more fully described below, include a limit switch 115 secured to the rear cross beam 117 of the carriage frame's intermediate slide section 59. The limit switch will be tripped by a limit switch cam 119, 121 located on the underside of the upper slide section 60 in line with the limit switch. It is noted that two limit switch cam positions 119, 121 are provided for in FIG. 5. The outer cam 121 trips the limit switch 115 to interlock the trolley and hoist as described below later than would be the case with the set back cam 119. The choice of cam position will depend on the particular dimensions of the crane on which the service platform apparatus is used and the inner cam position 119 generally illustrates the difference in the cam positioning for a Paceco Low-Profile PORTAINER $_R$ crane. The cam position is choosen so that the work platform will not hit the A-frame structure 13 when the service platform apparatus is trollied.

Figure 9:
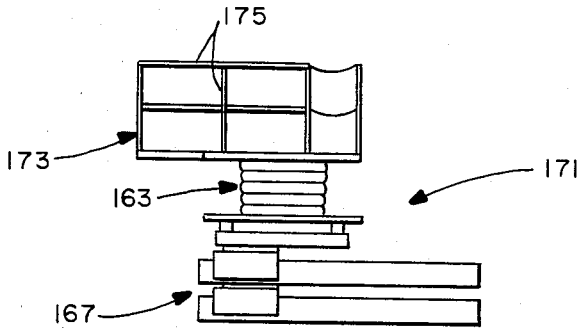
FIG. 9 is a side elevation view of one of the working platform units assembled for installation over the service platform apparatus' base frame.
Figure 11:
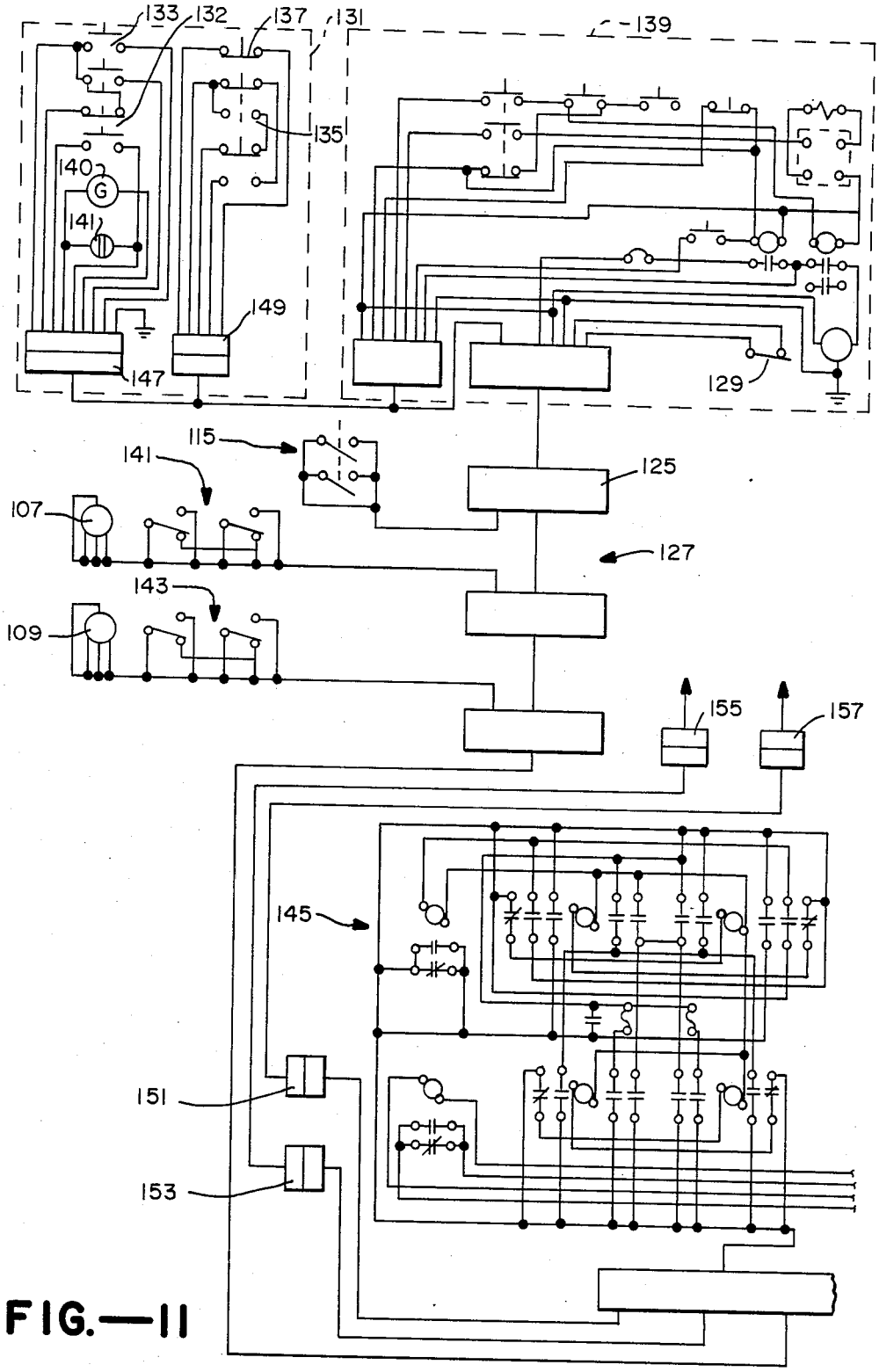
FIG. 11 is a schematic wiring diagram illustrating a wiring scheme for the invention.

FIG. 11 shows a suitable general wiring scheme for one-half of the service platform apparatus 25, the wiring for the remaining half being identical to that shown in FIG. 11. Referring to FIG. 11 the above-described carriage frame limit switch is seen as a two way switch 115 wired via terminal 125 to the main multiconductor line 127 which electrically connects the work platform, scissors lift and carriage frame to the base frame 27. An additional limit switch 129 is located at the bottom of the scissors lift; this interlock switch is closed when the scissors lift is fully lowered to a stowed position as shown in FIG. 9. As hereinafter described, the crane controls for moving the entire service apparatus 11 in the hoist and trolley directions are, by means of the limit switches 115, 129, preferably interlocked with the carriage frame and scissors lift positions.

Figure 10:
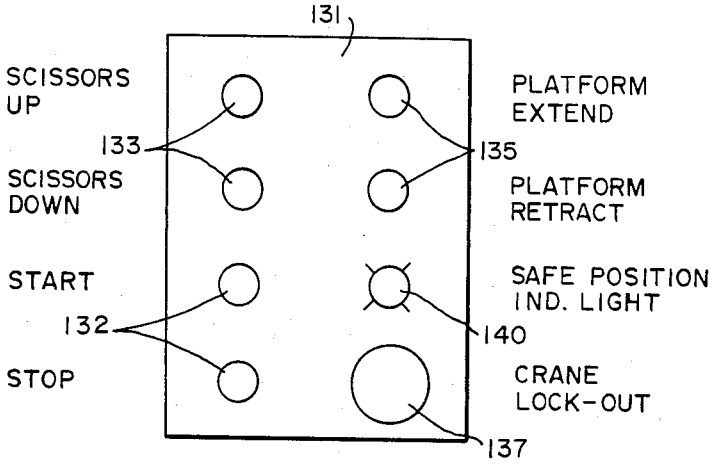
FIG. 10 is a pictorial, front elevation view of the work platform's control panel.

With reference to FIGS. 3, 10 and 11, it is seen that each of the work platforms 49, 50 has a control panel 131, which is easily accessible by a service or maintenance person standing on the platform. Each control panel has stop and start push button switches 132, two push button switches 133 for permitting the maintenance operator on the work platforms to remotely raise and lower the scissors lift for his or her platform, and two additional push button switches 135 to also permit the operator to remotely extend and retract the sliding carriages frames. These controls are in addition to the control of the hoist and trolley movements of the service platform apparatus in the hands of the crane operator in the crane cab 12 located under the crane gantry 15.

For safety, the service platform control panel 131 is additionally provided with a mushroom head push button lockout switch 137 which can be quickly actuated by the worker on the platform 49, 50 to completely disable the crane controls. To provide this safety crane control lockout the existing electrical controls in the crane cab 12 can readily be modified to accept the lockout switch control. Each work platform control panel also has a green indicator light 140 to indicate a safe to operate condition, which condition is hereinafter described, as well as an accessory power outlet 141.

FIG. 11 next shows the general circuit 139 for the scissors lift drive and limit switch together with a possible separate push button controls at the bottom of the scissors lift from which the scissors lift can be operated. FIG. 11 also shows the jack screw motors 107, 109 located on the sliding carriage frame as shown in FIG. 6, limit switches (not shown), 143 for the jack screw motors to limit the travel of the slide sections 59, 60, and associated relay circuitry 145 located on the base frame. When the service platform apparatus is assembled as hereinafter described, electrical connections between the service platform, the base frame, and the crane cab 12 are made through various electrical connectors such as connectors 147, 149, 151, 153, 155, 157. The connectors 155, 157 are the headblock connectors to be found on the headblock for providing power to operate the twistlocks and retractable corner guides of a lifting spreader. Additional wiring for the crane lockout can be added by using spare conductors in the lift beam cable 42.

Finally, it is noted that FIG. 11 is simply representative of a suitable electrical circuit for the electrical controls of the invention. From this disclosure, any suitable wiring scheme could be implemented by a person skilled in the electrical arts.

Field Assembly

Figure 8:
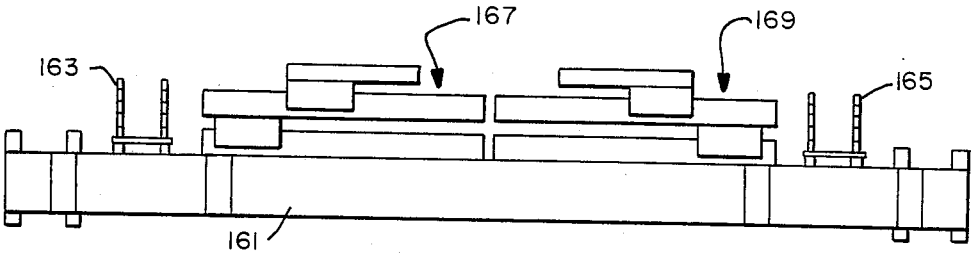
FIG. 8 is a side elevation view of a service platform apparatus in accordance with the invention knocked down and in a stowed position, ready for truck, rail or vessel transport within standard sized cargo container.

With reference to FIG. 8, the service platform apparatus 25 shown fully assemblied in FIG. 3 can be shipped and stored in a relatively compact knocked-down position wherein the twin scissors lifts 163, 165 and twin sliding carriage frames 167, 169 are secured in a folded position onto the base frame 161. The disassembled work platforms and tower frames of the service apparatus are also stored on the base frame. The unit is transportable like a standard cargo container in its knocked down form.

Field assembly is accomplished with the aid of the gantry crane with which the service apparatus is used. Assembly will be described with reference to the apparatus shown in FIG. 3. To assemble the service platform apparatus 25 in the field, the scissors lifts 51, 52 are unbolted from the base frame 27 and removed by the crane to a position beside the base frame. The tower frames 61, 63 are then removed and assembled over the base frame. The sliding carriage frames and work platforms 49, 50 are removed from the base frame and the work platforms assembled by installing and securing its detachable guardrails 175 about the platform's periphery. The work platforms 49, 50 are then mounted on top of the respective scissors lifts with the outboard hinged extensions 179, 180 in the up position, and thereafter the resulting scissors lift and work platform assemblies are lifted by the crane to the top of their respective sliding carriage frames 55, 56 and secured thereto by suitable bolt attachments. These resulting service platform units 45, 47 are in turn crane lifted to the top of and secured to the tower frames preassembled over the ends of the base frame. After both of the twin service platform units are thusly secured over the base frame the base frame is lifted by the crane, and the lifting spreader suspended from the bottom of the base frame by a linkage means as shown in FIG. 3. This is done in order to lower the entire apparatus' center of gravity and to thereby stabilize the apparatus. Any fixed spreader of any ASA/ISO configuration, or a telescopic spreader, can be used for stabilization. It is found, for example, that suitable stabilization can be achieved by suspending a thirty five foot lifting spreader approximately seven feet below a correspondingly sized base frame. It shall be understood that a counterweight other than a spreader could be used for stabilization.

Initial use of the service platform will require some modification to the control system in the cab as above mentioned. This modification will be dependent upon the type of control used on a particular crane and is done to allow for the connection of a remote interlocking relay panel (not shown) to the crane control panel wiring. Once this modification is made to the crane cab, it would only be necessary to remove jumpers in order to connect the interlocking panel in the crane and to reconnect these jumpers after using of the service platform apparatus.

As to electrical connections required during field assembly, the headblock cable 42 will be unplugged from the lifting beam receptacle and plugged into the receptacle in the base frame as shown in respect to headblock connectors 155, 157 in FIG. 11. The cable between the base frame and scissors lift (connectors 151, 153) and the cables between the control panels of the work platforms and the scissors lifts (connectors 147, 149) will further need to be connected as well as any other connectors that may be provided.

To knock down and stow a service platform apparatus, the above described assembly steps will simply be reversed after the sliding carriage assemblies are fully retracted and the vertical scissors lifts are in their lowest position. It is noted that the service platform apparatus, when knocked down, would preferably be of an overall dimension which can be placed in the volume occupied by a standard 40 foot cargo container. A bottom surface of the platform's base is also preferably provided with standard ISO or Sealand corner castings at 40 foot positions to allow securing the platform to the deck of a ship during ship transportation. The base frame is further preferably designed to allow placing on tunnel chassis for transportation over the road or within a yard.

Finally, access ladders capable of reaching the work platform from the ground when the scissors lift is down can also be stored on the base frame.

Operating Details

Figure 3A:
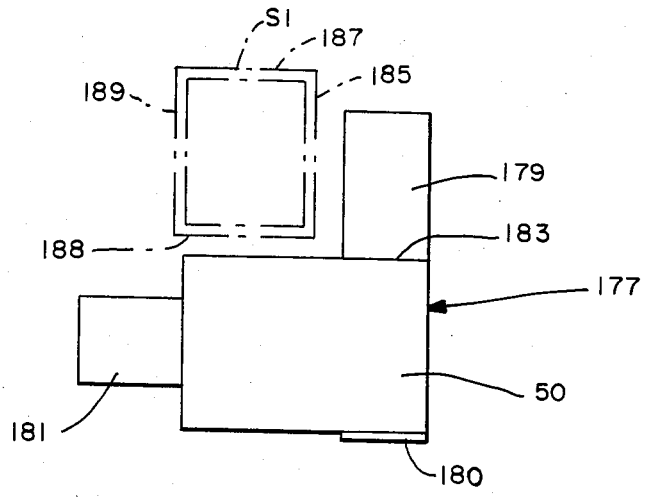
FIG. 3A is a top plan view of the right-hand work platform of the service platform apparatus shown in FIG. 3, positioned adjacent the leg of the crane's support structure.

The following describes the operation and interlocking of the service platform apparatus as above-described. In terms of its general operation, the service platform apparatus 25 is intended to be used in conjunction with the crane, hoist, and trolley motions of the crane. With reference to FIGS. 3 and 3A, this will allow access to the crane from the top of the boom structure, such as the alternatively sized booms B1, B2 shown to the left of FIG. 3, down to the bottom of the legs of the support frame. The right hand portion of FIG. 3 shows two different leg positions S1, S2 in relation to a laterally extended work platform 50 for two typical crane designs. FIG. 3A shows how one of the outboard hinged extension 179 of the work platform can be deployed to reach the outside surface 185 of the support frame leg S1. The hinge for this extension is denoted by the number 183.

To service the boom structure the crane operator will raise and trolley the service platform apparatus in the hoist and trolley directions to a required height and longitudinal position. The platform operators will then use the platforms' control panels 131 to traverse and raise and lower the work platforms on the base frame so as to maneuver the platforms adjacent to the boom members to be inspected or serviced (see the left-hand side of the service platform apparatus shown in FIG. 3). The platform scissors lifts 51, 52 will be utilized to access the top and bottom of the boom, while to access the entire length of the boom the platform operator will instruct the crane operator in the crane cab 12 to move the crane trolley in the trolley direction. While working on the boom the platform operator will lock out the crane trolley and hoist controls by pushing the mushroom head lock out button on the work platform's control panel 131. It is noted that the inside of the bottom structure can be accessed by an inboard lateral movement of the work platforms on the sliding carriage frames so that the narrow inboard extended end 181 of the work platform is inserted between the boom struts 190.

To service the crane support structure 13 the crane operator will position the service platform apparatus 25 alongside the structural member to be inspected or serviced, such as the support structure leg S1 shown at the right-hand side of FIG. 3. Then by separately actuating the sliding carriage frames 55, 56 and scissors lifts 51, 52 the platform operators can easily access the two sides 187, 188, or the inside face 189 of the support structure legs S1 or S2; additionally, by folding down one of the hinged extensions 179, 180 of the work platforms 49, 50, the outside face 185 of the support structure leg can be accessed from the work area provided by the extension. By means of the crane's hoist controls the entire leg S1 or S2 can be accessed from bottom to top.

It is noted that the operation of the service platforms require communication between the platform operator and the crane operator in the remote crane cab. Such communication can easily be supplied by a walkie-talkie or an intercom system wired between the platform, the operator's cab and ground level.

The Interlock System

The interlocks, actuated by the limit switches 115 on the sliding carriage frames 55, 56 and limit switches 129 on the scissors lifts 51, 52, operate to limit the hoist and trolleying movements of the crane when either of the work platforms 49, 50 are in a traversed position by virtue of the extension of the sliding carriage frames 55, 56 or in a raised position by virtue of the raising of the scissors lifts 51, 52. Also, a green "safe to operate" light is provided on the work platform panel 131 to indicate to the platform operator whether it is safe to hoist or trolley the service platform apparatus from the crane cab.

One interlock scheme involving slow speed crane operation with raised scissors lifts is as follows: the scissors lifts are interlocked such that the crane operation, namely, the trolley and hoist movements of the crane, are limited to a percentage of full speed (e.g. 20%) when either of the scissors lifts 45, 47 is in any position above its lowest position as shown in FIG. 9. The traversing movements of the work platforms 49, 50 are additionally interlocked such that the hoist and trolley movement of the crane will be fully prevented when either work platform is displaced laterally from its central position to a lateral displacement limit point beyond which trolleying in the trolley direction could cause the work platform to hit the crane's support structure 13. Just before this lateral displacement limit occurs the sliding carriage frame will actuate the properly positioned limit switch 115, and the green "safe to operate" indicator light will go off. For the green "safe to operate" light to be on, both platforms must be in a retracted position inboard of the limit point. It should be remembered that the platform operator has control of the hoist and trolley motions at all times and that the operator may push the mushroom head "crane lock out" button on the platform's control panel 131 to totally disable the crane hoist and trolley operations.

To reposition a platform to a new inspection area, both platforms should be traversed to their central position such that the green "safe to operate" lights on the control panels of both platforms are on. The platform operators must also release the crane lock out buttons at which time the work platforms may be repositioned by the crane operator through hoisting and trolleying motions at a predetermined slow speed, for example, 20% of full speed. If high speed repositioning is desired, both platforms must be lowered to their fully stowed position. During any repositioning, the platform operator should also hinge up the hinged platform extensions 179, 180. In the above-described manner, the work platforms can be repositioned to any desired location on the crane from the top of the boom to the bottom of the crane's support structure for all required inspection and maintenance on these structures.

An alternative and safer interlock scheme can be provided wherein crane hoist and trolley movements are fully prevented by either a laterally displaced work platform or a raised platform. With such an interlock scheme there would be no possibility of slow speed crane repositioning with the scissors lift extended. Rather, in order to reposition the work platforms through hoist or trolley motions, the scissors lift would first have to be lowered in addition to retracting the work platform inboard of its lateral displacement limit point. Such an interlock scheme would prevent any possible collision with the boom structure that might be caused, for example, if the platform operator failed to lock out the crane controls when servicing the boom and the crane operator inadvertently actuated the crane's trolley controls. It is evident that interlock schemes could be devised other than those above-described.

Therefore, it can be seen that the present invention is a unique service platform apparatus which preferably is comprised of twin work platforms which can be traversed and raised and lowered on a base frame and each of which is independently under the control of a platform operator on the work platforms. The apparatus provides for efficient and safe inspection and maintenance of a crane structure and can easily be knocked down and stowed in a compact form for shipping. While twin work platforms are described it is understood that the apparatus constructed in accordance with the invention might have only one platform or multiple platforms.

Although the present invention has been described in considerable detail in the foregoing specification, it is not intended that the invention be limited by such detail except as necessitated by the following claims.

What we claim is:

1. A service platform apparatus for a gantry crane having a crane support structure, a horizontal boom structure and gantry, a trolley moveable on said boom and gantry, lifting ropes depending from said trolley and actuated by crane mounted hoist machinery, and a headblock reeved to the lower ends of said lifting ropes, said service platform apparatus comprising a base frame adapted to be releasably secured to said headblock, a pair of work platforms mounted above said base frame on opposite sides of the interconnection of said headblock with said base frame, said work platforms including a multiplicity of horizontal retractable extensions, means for independently raising and lowering said work platforms relative to said base frame and independently moving said work platforms laterally inboard and outboard along said base frame, and remote control means on said platforms for permitting an operator on a particular work platform to independently control the raising and lowering and lateral movement of that work platform relative to said base frame.

2. The service platform claim 1 wherein a counterweight is suspended below said base frame for stabilization.

3. The service platform apparatus of claim 2 wherein said base frame is provided with linkage means for suspending a conventional lifting spreader below said base frame as said counterweight.

4. The service platform apparatus of claim 1 including means for interlocking the trolley and hoist controls of said crane with the position of said work platform whereby full speed operation of the hoisting and trolley functions of the crane are restricted whenever a work platform is displaced from a predetermined position relative to the base frame and whereby hoist and trolley motions are prevented for any position of a work platform which would permit it to hit or interfere with the crane support structure when moved.

5. The service platform apparatus of claim 4 wherein the hoist and trolley speed of the crane is limited to approximately 20% of full speed when a work platform is in a raised position.

6. The service platform apparatus of claim 1 wherein said remote control means on said work platform includes a manual crane lockout switch within reach of an operator standing on said platform whereby said operator, by actuating said lockout switch, can interrupt any hoist or trolley movement of said crane.

7. A service platform apparatus for a gantry crane having a crane support structure, a horizontal boom structure and gantry, a trolley moveable on said boom and gantry, lifting ropes depending from said trolley and actuated by crane mounted hoist machinery, and a headblock reeved to the lower ends of said lifting ropes, said service platform apparatus comprising a base frame adapted to be releasably secured to said headblock, a counterweight suspended below said base frame for stabilization, a pair of mirror image twin work platforms mounted above said base frame on integrated structures including a pair of tower frames adapted to be assembled over and secured to opposite lateral ends of the base frame on opposite sides of the attachment of the headblock to the base frame, a sliding carriage frame and drive means for laterally extending and retracting same secured to the top of each of said tower frames, scissors lifts supported on each of said sliding carriage frames, said work platforms being supported on the top of said scissors lifts, a multiplicity of horizontal retractable extensions mounted on said platforms to provide additional floor work-space to said platforms, remote control means on said platforms for permitting an operator on a particular work platform to independently control the raising and lowering of that platform and the laterally traversing of said base frame by said platform, said control means including a manual crane lockout switch within reach of the operator for interrupting any hoist or trolley movement of said crane, means for interlocking the trolley and hoist controls of said crane with the position of said work platform whereby full speed operation of the hoisting and trolley functions of the crane are restricted whenever a work platform is displaced from a predetermined position relative to the base frame and whereby hoist and trolley motions are prevented for any position of a work platform which would permit it to hit or interfere with the crane support structure when moved.

8. The service platform apparatus of claim 7 wherein said tower frames and service platform units are adapted to be disassembled and stowed on said base frame.

9. The service platform apparatus of claim 8 wherein the base frame with the tower frames and service platform units disassembled and stowed on said base frame is sized to fit within a standard forty foot cargo container.

* * * * *

UNITED STATES PATENT AND TRADEMARK OFFICE

CERTIFICATE OF CORRECTION

PATENT NO. : 4,546,852

DATED : October 15, 1985

INVENTOR(S) : John F. Martin and Charles H. Zweifel

It is certified that error appears in the above—identified patent and that said Letters Patent is hereby corrected as shown below:

Col. 5, line 31, the word "life" should be --lift--.
Col. 9, line 37, the word "bottom" should be --boom--.

Signed and Sealed this

*Twenty-fourth* Day of *December 1985*

[SEAL]

*Attest:*

DONALD J. QUIGG

*Attesting Officer*

*Commissioner of Patents and Trademarks*